US005325085A

United States Patent [19]

Decker

[11] Patent Number: 5,325,085

[45] Date of Patent: Jun. 28, 1994

[54] ANTI-INTRUSION ALARM DEVICE FOR AUTOMATIC USER ACTUATION AT AN ENTRANCE TO A STRUCTURE

[76] Inventor: Michael Decker, 111 Haberdasher Street, London N1 6EH, Great Britain

[21] Appl. No.: 876,231

[22] Filed: Apr. 30, 1992

[51] Int. Cl.[5] ..... G08B 15/00

[52] U.S. Cl. ..... 340/574; 340/548; 340/568

[58] Field of Search ..... 340/574, 548, 568

[56] References Cited

U.S. PATENT DOCUMENTS

| | | | |
|---|---|---|---|
| 4,258,359 | 3/1981 | McLamb | 340/546 |
| 4,262,180 | 4/1981 | Walter | 340/574 |
| 4,284,982 | 8/1981 | Downey | 340/574 |
| 4,394,644 | 7/1983 | Dileo | 340/542 |
| 4,586,028 | 4/1986 | McKinzie | 340/546 |
| 4,633,232 | 12/1986 | Nelson | 340/542 |
| 5,075,671 | 12/1981 | Livingston, III | 340/574 |

FOREIGN PATENT DOCUMENTS

| | | |
|---|---|---|
| 2101783A | 1/1983 | United Kingdom . |
| 2102998A | 2/1983 | United Kingdom . |
| 88/07350A1 | 10/1988 | World Int. Prop. O. . |

*Primary Examiner*—Glen R. Swann, III
*Attorney, Agent, or Firm*—Herbert Dubno

[57] ABSTRACT

An alarm device has an actuating member for energising the alarm, the member being placed in its actuating state by passive action on the part of the user in the case of an emergency. A preferred form of actuating member according to the invention is a ring pull, in which the alarm device is caused to operate by the ring pull being pulled away from the remainder of the device.

6 Claims, 2 Drawing Sheets

ANTI-INTRUSION ALARM DEVICE FOR AUTOMATIC USER ACTUATION AT AN ENTRANCE TO A STRUCTURE

BACKGROUND OF THE INVENTION

My present invention relates to an alarm device, particularly for a door or the like.

FIELD OF THE INVENTION

Current safeguards against forced entry to a home where a householder has opened a streetdoor from three groups:

a) Peephole or video identification of visitor prior to admittance.

b) Door chain or similar door retention systems.

c) Panic buttons.

These three groups are well-established proven approaches, although each has inherent disadvantages which leave the householder exposed to attack.

OBJECT OF THE INVENTION

It is the object of the invention to provide an improved alarm device which avoids drawbacks of earlier systems of household protection.

SUMMARY OF THE INVENTION

According to the invention there is provided an alarm device having an actuating member for energizing the alarm, the member being placed in its actuating state by other than pushing of a button. Pushing of a button requires positive action, whereas the present invention covers operations which are passive. A preferred form of actuating member is a ring pull, in which the alarm device is caused to operate by the ring pull being pulled away from the remainder of the device. An alternative form of member could cause the device to operate by being moved transversely to its length, e.g. by being pulled sideways by a finger hooked over it.

BRIEF DESCRIPTION OF THE DRAWING

An embodiment of the invention will now be described with reference to the accompanying drawing in which.

DESCRIPTION OF THE PREFERRED EMBODIMENT

Figure 2:
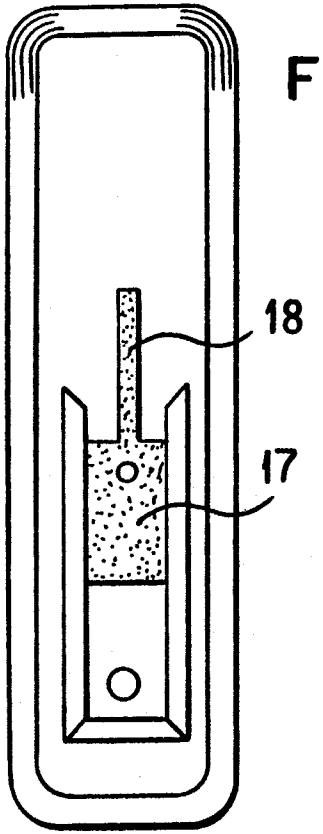
FIG. 2 shows the inside of the cover.

The device illustrated in the drawing is a small unit fixed to the door frame upright at a point where it falls naturally under the hand of the householder. A pin complete with attached ring 12 (similar to the pin/ring arrangement of a hand/grenade) protrudes from the unit. While one hand opens the door, a finger on the other hand is slipped through the ring (12). Should the householder be pushed back into the residence the pin/ring will become detached from the unit, causing 'detonation' of a sounder similar to those found in proprietary smoke alarms. The device is battery powered, and thus is a 'stand alone' unit, although there are optional extra internal switches to allow it to be connected to the householder's existing alarm system if required. The sounder will continue to operate until the pin is replaced in the device. This is achieved by using a supplied 'key' which is used to raise a spring-loaded slide mounted inside the cover that drops over the hole left by the removal of the pin.

Figure 1:
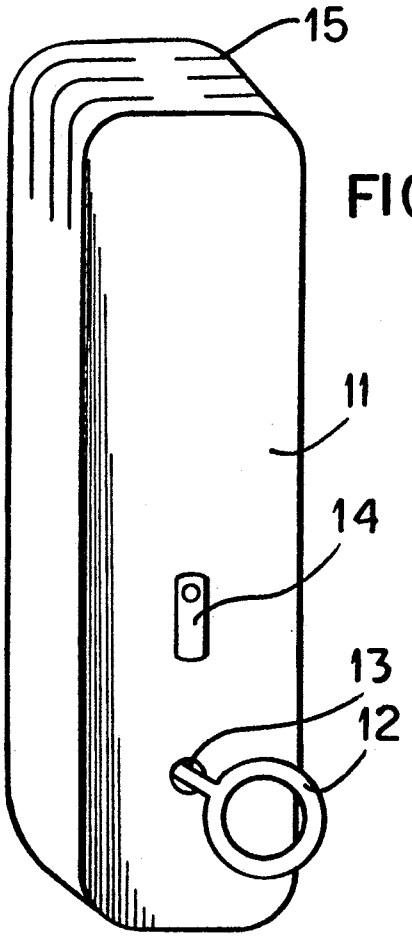
FIG. 1 is a front perspective view of an alarm device according to the invention.
Figure 4:
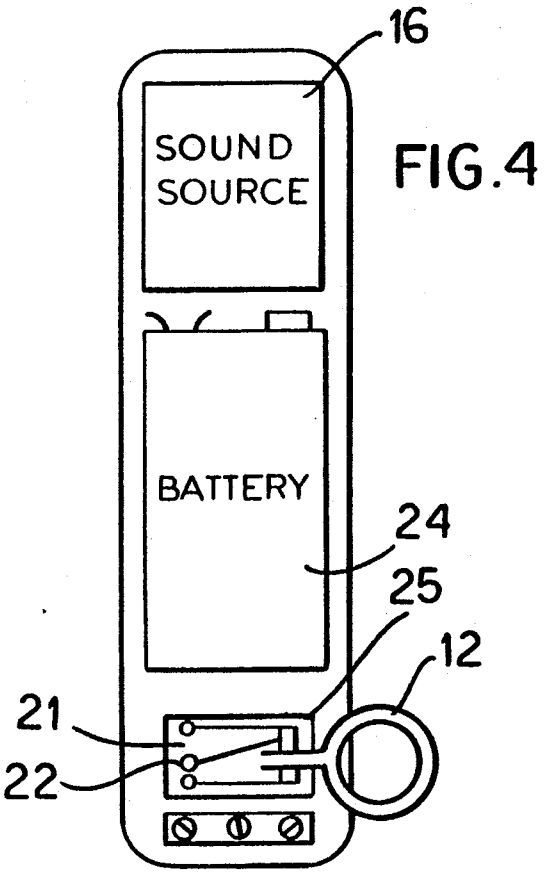
FIG. 4 is a schematic diagram of the device of FIG. 1.
Figure 3:
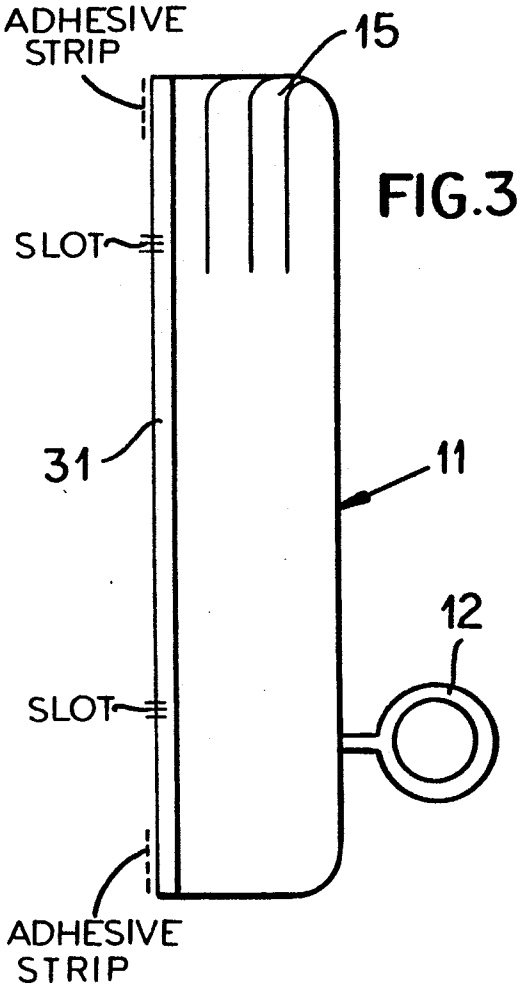
FIG. 3 is a side elevation of the device of FIG. 1.

The cover 11 shown in FIG. 1 has a ring pull 12 extending from an aperture 13 near the lower end of the front panel. Above the aperture 13 is a keyhole 14. At the top are sound apertures 15 to allow sound to escape from an alarm sounder 16 inside (see FIG. 4). FIG. 4 also shows how the ring pull 12 activates two switches 21, 22, removal of the pull opening the normally closed switch 21 and closing the normally open switch 22.

Switch 22 is connected in the activating circuit of the sounder 16 which is energized from battery 24, all contained within the cover 11. Both Switches 21 and 22 are connected to the terminals 25 at the base of the device for connection to a general home intruder alarm system should this be required, opening of the switch 21 or closing of switch 22 when so connected causing the home alarm system to operate.

Any attempt to cut wires to the device from the electrical power box will result in the opening of the 'normally closed' circuit and thus trigger the main alarm system (though NOT the alarm device itself).

As shown in FIG. 2, the rear of the front panel of the cover 11 contains a vertical guide 18 for a slide member 17. The member 17 is biassed downwards by gravity (or alternatively by means of a spring). When the ring pull is removed from the aperture 13, the member 17 drops down behind it and prevents the stem of the ring pull (or any other device) from being inserted through the aperture 13 behind the guide 18 to change the state of the switches 21, 22. The keyhole 14 allows a key to be inserted to raise the slide member 17 to allow the ring pull stem to be inserted to stop the alarm from sounding.

The device utilizes a baseplate 31 which is screwed to the door jamb (although it could be attached with a double-sided adhesive pad). Mounted on the baseplate are all the other components except the spring-loaded slide 17. Thus battery 24, sounder 16, switches 21 and 22, wiring and perhaps any circuitry required to provide intermittent tone to the sounder are all enclosed by the cover 11. The pin/ring unlike those of a real hand grenade, is manufactured as one piece; thus the ring extends out from the unit as opposed to hanging down from the pin.

Alternative actuating members include a rectangular 'ring' and pin arrangement, or indeed a ring and pin any other geometric shape that encloses a finger, a plurality of fingers, part of a hand or the whole hand. A hook or any non-enclosing shape can also be used.

The actuating member could be operated by removal of the hand or part of the hand from the member; for example a bar behind which fingers are hooked but is non-detachable, or perhaps a large recess in a device from which careful removal of the finger is required to avoid triggering.

It is possible to add a mechanical linkage connecting the ring to the door to provide night security in the event of the door being forced. For example, a short length of chain attached to the door can be affixed to the ring of the device thus triggering the unit should the door be opened.

An alternative power source is pneumatic. Use of compressed air, as seen in 'rape alarms' or similar, provides a loud sound. A suitable activating system between the ring pull and the pneumatic system would be substituted for the switch 22 described above.

I claim:

1. An alarm device for signalling intrusion, comprising:

a housing having a front face formed with a hole;

means for affixing said housing to a surface adjacent an entrance to a structure to be protected against intrusion;

a sound source in said housing; and actuating means on said housing operatively connected with said sound source and including a pin receivable in and withdrawable from said hole in a direction substantially perpendicular to said front face, and a ring affixed to said pin and engageable by a user for activation of said sound source subsequent to the engagement thereof by the user without intentional action by the user with a pull of said pin in said direction.

2. The alarm device defined in claim 1, said actuating means including means for activating a building alarm system.

3. The alarm device defined in claim 1, further comprising a battery in said housing for energizing said sound source.

4. The alarm device defined in claim 1 wherein said means for affixing comprises slots.

5. The alarm device defined in claim 1 wherein said means for affixing comprises an adhesive strip.

6. The alarm device defined in claim 1, further comprising a slide along an inner surface of said front face and adapted to shift across said hole upon withdrawal of said pin therefrom, and a keyhole formed in said front face for receiving a key adapted to displace said slide and free said hole to receive said pin for replacement thereof in said hole.

* * * * *